US006555179B1

(12) United States Patent
Reeves et al.

(10) Patent No.: US 6,555,179 B1
(45) Date of Patent: Apr. 29, 2003

(54) ALUMINIZING PROCESS FOR PLASMA-SPRAYED BOND COAT OF A THERMAL BARRIER COATING SYSTEM

(75) Inventors: Jim D. Reeves, Cincinnati, OH (US); Bhupendra K. Gupta, Cincinnati, OH (US); Nripendra N. Das, West Chester, OH (US)

(73) Assignee: General Electric Company, Schenectady, NY (US)

( * ) Notice: Subject to any disclaimer, the term of this patent is extended or adjusted under 35 U.S.C. 154(b) by 609 days.

(21) Appl. No.: 09/527,270

(22) Filed: Mar. 17, 2000

Related U.S. Application Data

(62) Division of application No. 09/006,919, filed on Jan. 14, 1998.

(51) Int. Cl.[7] ..... C23C 4/06; C23C 4/10; C23C 16/08

(52) U.S. Cl. ..... 427/454; 427/456; 427/252; 427/253

(58) Field of Search ..... 427/454, 456, 427/252, 253; 428/623, 633, 632

(56) References Cited

U.S. PATENT DOCUMENTS 3,598,638 A * 8/1971 Levine
4,132,816 A * 1/1979 Benden et al. ..... 427/237
5,236,745 A * 8/1993 Gupta et al. ..... 427/454

* cited by examiner

*Primary Examiner*—Katherine A. Bareford
(74) *Attorney, Agent, or Firm*—David L. Narciso; Gary M. Hartman; Domenica N. S. Hartman

(57) ABSTRACT

A thermal barrier coating system and a method for forming the coating system on an article designed for use in a hostile thermal environment. The method is particularly directed to a coating system that includes a plasma-sprayed MCrAlY bond coat on which a thermal-insulating APS ceramic layer is deposited, in which the oxidation resistance of the bond coat and the spallation resistance of the ceramic layer are substantially increased by vapor phase aluminizing the bond coat. The bond coat is deposited to have a surface area ratio of at least 1.4 and a surface roughness of at least 300 $\mu$inch Ra in order to promote the adhesion of the ceramic layer. The bond coat is then overcoat aluminized using a vapor phase process that does not alter the surface area ratio of the bond coat. This process is carried out at relatively low temperatures that promote inward diffusion of aluminum relative to outward diffusion of the bond coat constituents, particularly nickel and other refractory elements. The process conditions also provide sufficient vapor phase activity at the surface of the bond coat that promote aluminum atomic movement through the bond coat.

8 Claims, No Drawings

ALUMINIZING PROCESS FOR PLASMA-SPRAYED BOND COAT OF A THERMAL BARRIER COATING SYSTEM

This is a division of patent application Ser. No. 09/006,919, filed Jan. 14, 1998, still pending.

FIELD OF THE INVENTION

This invention relates to thermal barrier coating systems for components exposed to high temperatures, such as the hostile thermal environment of a gas turbine engine. More particularly, this invention is directed to a thermal barrier coating system having a plasma-sprayed bond coat over which a thermal-insulating ceramic layer is deposited, wherein the bond coat undergoes vapor phase aluminizing to have an inward aluminide diffusion that promotes the oxidation resistance of the bond coat while maintaining the as-sprayed surface structure of the bond coat.

BACKGROUND OF THE INVENTION

Higher operating temperatures for gas turbine engines are continuously sought in order to increase their efficiency. However, as operating temperatures increase, the high temperature durability of the components of the engine must correspondingly increase. Significant advances in high temperature capabilities have been achieved through the formulation of nickel and cobalt-base superalloys, and through the development of oxidation-resistant environmental and thermal barrier coatings deposited on the surface of a superalloy substrate. Environmental coatings are generally employed to protect a superalloy substrate from oxidation, hot corrosion, etc., while thermal barrier coatings further serve to reduce heat transfer to the substrate. As a result, thermal barrier coatings (TBCs) are often used to protect components located in certain sections of a gas turbine engine, such as the turbine, combustor and augmentor.

To be effective, a thermal barrier coating must have low thermal conductivity, strongly adhere to the article, and remain adherent throughout many heating and cooling cycles. The latter requirement is particularly demanding due to the different coefficients of thermal expansion between materials having low thermal conductivity and superalloy materials typically used to form turbine engine components. Coating systems capable of satisfying the above requirements have generally required a metallic bond coat deposited on the component surface, followed by an adherent ceramic layer that serves as the thermal barrier coating. Various ceramic materials have been employed in this role, particularly zirconia ($ZrO_2$) stabilized by yttria ($Y_2O_3$), magnesia (MgO), ceria ($CeO_2$), scandia ($Sc_2O_3$), or another oxide. These particular materials are widely employed in the art because they can be readily deposited by plasma spray, flame spray and vapor deposition techniques.

Bond coats of TBC systems are typically formed from an oxidation-resistant aluminum-containing alloy to promote adhesion of the ceramic layer to the component and inhibit oxidation of the underlying superalloy. Examples of bond coats include overlay and diffusion coatings, each of which forms a protective oxide scale during high temperature exposure that chemically bonds the ceramic layer to the bond coat and protects the bond coat and the underlying substrate from oxidation and hot corrosion. Diffusion coatings are formed by reacting the surface of a component with an aluminum-containing composition, which typically yields two distinct zones, an outermost of which is an additive layer that contains the environmentally-resistant intermetallic phase MAl, where M is iron, nickel or cobalt, depending on the substrate material. Beneath the additive layer is a diffusion zone containing various intermetallic and metastable phases that form during the coating reaction as a result of diffusional gradients and changes in elemental solubility in the local region of the substrate. The total thickness of a diffusion coating is typically about 50 to 75 micrometers.

Overlay coatings are typically single-layer coatings of MCrAlY, where M is nickel, cobalt, iron or combinations thereof, deposited by low pressure plasma spraying (LPPS) and air plasma spraying (APS). The thickness of an overlay coating is typically about 75 to 175 micrometers. In contrast to diffusion coatings, overlay coatings are not an intermetallic, but are instead metallic solid solutions. Because APS bond coats are deposited at an elevated temperature in the presence of air, they inherently contain oxides and are more prone to oxidation. However, APS bond coats are often favored due to lower equipment cost and ease of application and masking. As a result, various approaches have been proposed to improve the oxidation resistance of APS bond coats, including overcoat aluminiding by which aluminum is diffused into the surface of the bond coat by pack cementation or non-contact vapor (gas) phase techniques. Each of these techniques is similar to that employed to form a diffusion aluminide bond coat, employing a mixture of an aluminum-containing powder (i.e., an aluminum donor), a carrier (activator) such as an ammonium or alkali metal halide, and an inert filler such as alumina to prevent sintering of the powder. The substrate to be treated and the mixture are then heated to about 1200–2200° F. (about 650–1200° C.) to produce a diffusion aluminide coating.

While overcoat aluminiding by pack cementation methods has been shown to be very effective and practical, as taught by U.S. Pat. No. 5,236,745 to Gupta et al., acceptable results have not been previously achieved with vapor phase deposition techniques because the resulting aluminide is primarily an outward diffusion coating that significantly smooths the surface of the bond coat. Accordingly, while vapor phase aluminiding (VPA) has been employed to form diffusion aluminide environmental coatings and bond coats, VPA processes have not been successful in suitably overcoat-aluminizing a plasma-sprayed bond coat to provide a surface to which a thermal barrier coating will adhere.

SUMMARY OF THE INVENTION

The present invention generally provides a thermal barrier coating system and a method for forming the coating system on an article designed for use in a hostile thermal environment, such as superalloy turbine, combustor and augmentor components of a gas turbine engine. The method is particularly directed to a coating system that includes a plasma-sprayed (APS or LPPS) MCrAlY bond coat on which a thermal-insulating APS ceramic layer is deposited, in which the oxidation resistance of the bond coat and the spallation resistance of the ceramic layer are substantially increased by vapor phase aluminizing the bond coat.

According to this invention, the bond coat is deposited to have a surface roughness of at least 300 $\mu$inch Ra, preferably about 300 to about 800 $\mu$inch Ra, in order to promote the adhesion of the ceramic layer. The oxidation resistance of the bond coat is then substantially improved by overcoat aluminizing the bond coat using a vapor phase process that maintains the as-sprayed surface structure of the bond coat. According to the invention, the surface structure of the bond coat is quantified by the surface area ratio of the bond coat—specifically, the actual surface area of the bond coat (including the slopes of the peaks and valleys) divided by the lateral surface area (the apparent area when viewed in a direction normal to the surface of the bond coat). According to the invention, in order for the vapor phase aluminiding process to maintain the surface area ratio of the bond coat, the process must be carried out at relatively low temperatures that promote inward diffusion of aluminum relative to outward diffusion of the bond coat constituents, particularly nickel and other refractory elements. In addition, process conditions must provide sufficient vapor phase activity at the surface of the bond coat that will promote aluminum atomic movement through the bond coat.

The reliance by this invention on inward diffusion over outward diffusion to overcoat aluminize a TBC bond coat is contrary to diffusion aluminide processes of the prior art, which have provided for outward diffusion to yield thinner diffusions that exhibit enhanced thermal fatigue resistance, as discussed in reference to an aluminide environmental coating disclosed in U.S. Pat. No. 5,217,757. However, in the context of over-aluminiding an APS or LPPS bond coat, the present invention evidences that inward diffusion aluminide layers having a thickness of roughly 75 micrometers can improve the oxidation resistance of the bond coat while having little if any detrimental effect on the surface structure of the bond coat. Accordingly, thermal barrier coating systems formed in accordance with this invention have been shown to exhibit enhanced spallation resistance, in contrast to prior art attempts to overcoat-aluminize bond coats by conventional vapor phase processes, which have resulted in, at best, thermal barrier coatings that rapidly spall when subjected to thermal cycling.

Other objects and advantages of this invention will be better appreciated from the following detailed description.

DETAILED DESCRIPTION OF THE INVENTION

The present invention is generally applicable to components that operate within environments characterized by relatively high temperatures, and are therefore subjected to severe oxidation, thermal stresses and thermal cycling. Notable examples of such components include the high and low pressure turbine nozzles and blades, shrouds, combustor liners and augmentor hardware of gas turbine engines. However, the teachings of this invention are generally applicable to any component on which a thermal barrier coating may be used to protect the component from its environment.

A thermal barrier coating system in accordance with this invention is generally characterized by a thermally-insulating ceramic layer on a bond coat that overlies a substrate, the latter of which is typically a nickel or cobalt-base superalloy. According to this invention, the bond coat is deposited by an APS or LPPS technique, and is preferably MCrAlY, a metallic solid solution where M is iron, cobalt and/or nickel. Due to the deposition process, the bond coat must have a sufficiently rough surface, at least about 300 inch Ra, in order to tenaciously adhere the ceramic layer to the substrate. The ceramic layer is preferably deposited by APS so as to be compatible with the bond coat. A preferred material for the ceramic layer is an yttria-stabilized zirconia (YSZ), a preferred composition being about 6 to about 8 weight percent yttria, though other ceramic materials could be used, such as yttria, nonstabilized zirconia, or zirconia stabilized by magnesia, ceria, scandia or another oxide. The ceramic layer is deposited to a thickness that is sufficient to provide the required thermal protection for the underlying substrate, generally on the order of about 75 to about 300 micrometers.

As taught by U.S. Pat. No. 5,236,745 to Gupta et al., the oxidation resistance of an APS bond coat is significantly enhanced by overcoat aluminizing the bond coat. While Gupta et al. report the success of overcoat aluminizing by pack cementation, the present invention is directed to a modified vapor phase aluminizing process that produces an inward diffusion which does not alter the desired surface structure of the bond coat, but instead maintains the surface structure that promotes adhesion of a thermal barrier coating to the bond coat. Accordingly, the present invention overcomes the principal obstacle to prior art attempts to employ vapor phase aluminizing to improve the oxidation resistance of an APS or LPPS bond coat.

According to the invention, specific parameter limitations have been identified as being necessary to adapt vapor phase deposition to the present application. These parameters were the result of certain physical requirements for the aluminide coating having been identified during investigations that led to the invention. Specifically, preliminary attempts to aluminide an APS bond coat using conventional vapor phase deposition parameters reduced the surface roughness to an unacceptable level where a ceramic TBC would either fail to adhere or spall almost immediately during thermal cycle testing. These attempts eventually led to the determination that the primary mode of aluminum transfer to the bond coat should be by inward diffusion to form nickel aluminide (NiAl) at the bond coat surface, instead of NiAl forming as an outward diffusion layer on the bond coat. That sufficient inward diffusion has occurred was quantified by an aluminum concentration at the surface of the bond coat of at least 30 weight percent, and a nickel concentration at the surface of the bond coat of less than 50 weight percent. The factors for achieving this result were identified as aluminum atomic movement under sufficient surface aluminum activity, the diffusion coefficient of aluminum in the base constituent of the bond coat (e.g., nickel), and the diffusion temperature. The primary aluminum diffusion kinetics are understood to be by inward diffusion to form NiAl under hyperstoichiometric NiAl surface conditions and lower diffusion temperatures.

During initial testing, conventional VPA processing parameters did not produce the desired inward diffusion aluminide, and the parameters that achieve the necessary diffusion mechanism were not readily ascertainable. Instead, suitable results were confirmed by vertical inferometer evaluations only after making considerable modifications to the coating parameters, in combination with the use of certain activators and aluminum donors that sufficiently increased surface aluminum activity. According to this invention, the following vapor phase deposition parameters are necessary to produce an inward diffusion aluminide that will not significantly alter the surface structure of an APS or LPPS bond coat.

TABLE I

| PARAMETER | RANGE | PREFERRED |
|---|---|---|
| Temperature: | 1700–1900° F. (925–1040° C.) | 1850° F. (1010° C.) |
| Aluminum donor: | 30–60 weight % Al | $Co_2Al_5$ |
| Activator: | Aluminum halide | $AlF_3$ |
| Coating Time: | 4–12 hrs. | 6 hrs. |

According to the invention, the bond coat also should have optimal surface conditions for the vapor phase process. Generally, APS and LPPS bond coats are deposited to have a minimum surface roughness. Bond coats within the scope of this invention preferably have a surface roughness of at least 300 $\mu$inches Ra, preferably 300 $\mu$inches to 800 $\mu$inches Ra. However, in accordance with this invention, the surface area ratio of the bond coat is more critical to the adhesion of an APS ceramic layer, while surface roughness (as quantified by Ra) is less reliable as an indicator of spallation resistance. As used herein, the term "surface area ratio" is understood to mean the actual surface area of the bond coat (including the slopes of the peaks and valleys) divided by the lateral surface area (the apparent area when viewed in a direction normal to the surface of the bond coat). A minimum surface area ratio is at least 1.4, preferably about 1.6 or more. Surprisingly, while prior art VPA processes are capable of yielding an aluminized bond coat with a surface roughness of 300 μinches and more, the outward diffusion of such processes reduces the surface area ratio below that required and achieved by the present invention.

During investigations that led to this invention, furnace cycle testing was performed on nickel-base superalloy specimens having APS ceramic layers deposited on overcoat-aluminized APS bond coats. Following heat treatment at about 1925° F. (about 1050° C.) for about three hours in a vacuum, some of the bond coats were aluminized by the vapor phase process of this invention, while others were aluminized by conventional vapor phase parameters, as outlined below. The superalloy was René 80, having a nominal composition in weight percent of 14% chromium, 9.5% cobalt, 5% titanium, 3% aluminum, 4% molybdenum, 4% tungsten, 0.03% zirconium, 0.17% carbon and 0.015% boron, the balance nickel. The bond coats were of the material known as BC52 having a nominal composition, in weight percent, of 18% chromium, 10% cobalt, 6.5% aluminum, 2% rhenium, 6% tantalum, 0.5% hafnium, 0.3% yttrium, 1% silicon, 0.015% zirconium, 0.06% carbon and 0.015% boron, the balance nickel. Bond coat thickness was about 0.006 to about 0.008 inch (about 150 to about 200 μm). The bond coats were deposited by APS from a powder having a particle size of about 120 to 270 mesh to yield a surface roughness of about 533 to 651 μinches (about 13.5 to about 16.5 μm) Ra. The ceramic was yttria stabilized zirconia (YSZ) with a thickness of about 0.012 inch (about 300 μm).

The specimens were aluminized according to prior vapor phase deposition methods and the method of this invention, as indicated below.

TABLE II

| PARAMETER | PRIOR ART | INVENTION |
|---|---|---|
| Temperature: | 1080° C. | 1010° C. |
| Duration: | 6 hrs. | 6 hrs. |
| Aluminum donor: | CrAl (70% Cr, 30% Al) | $Co_2Al_5$ |
| Activator/conc.*: | $NH_4F$; 1 g/l | $AlF_3$; 1.8 g/l |

*Concentration in grams of activator per liter of coating container volume.

The above parameters are those critical to the invention. Notably, process activity is directly proportional to the activator concentration, and affects coating thickness and aluminum concentration in the diffusion. The above parameters of this invention yielded an inward diffusion aluminide in the surface of the bond coat, while the prior art parameters yielded primarily an outward diffusion aluminide on the surface of the bond coat. The average thicknesses of the resulting aluminide layers and bond coats of the specimens processed in accordance with this invention were about 0.0030 inch (about 76 μm) and about 0.0063 inch (about 160 μm), respectively. In contrast, the average thicknesses of the aluminide diffusion layers and bond coats of the specimens processed in accordance with the prior art were about 0.0016 inch (about 41 μm) and about 0.0031 inch (about 79 μm), respectively. The compositions of the aluminide layers were then quantified (in weight percent) with a microprobe at about five μm below the surface of the bond coats.

TABLE III

| | PRIOR ART | | INVENTION | |
|---|---|---|---|---|
| | PEAK | VALLEY | PEAK | VALLEY |
| Ni | 58.8% | 61.0 | 39.8 | 47.5 |
| Cr | 3.08 | 3.92 | 12.5 | 7.26 |
| Co | 8.98 | 7.86 | 6.8 | 7.57 |
| Mo | 0.07 | 0.04 | 0.09 | 0.11 |
| Ta | 0.43 | 0.57 | 4.00 | 0.33 |
| W | 0.00 | 0.00 | 0.00 | 0.00 |
| Re | 0.05 | 0.01 | 1.07 | 0.44 |
| Hf | 0.00 | 0.02 | 0.55 | 0.00 |
| Al | 30.2 | 28.1 | 34.0 | 38.3 |
| Si | 0.08 | 0.04 | 0.91 | 0.05 |
| Fe | 0.05 | 0.06 | 0.03 | 0.03 |
| Ti | 0.00 | 0.02 | 0.26 | 0.03 |

The above evidences that considerable diffusion of nickel to the surface of the bond coat occurred as a result of the prior art aluminizing process, with the result that the nickel surface concentration was actually higher than in the BC52 bond coat alloy (nominally 56 weight percent). In contrast, the aluminizing process of this invention reduced the nickel concentration at the bond coat surface to a level well below that of BC52. Also notable are the dramatically higher chromium and rhenium levels in the aluminide produced by this invention, which are believed to promote the environmental and mechanical properties of the bond coat.

Following vapor phase aluminiding, the bond coats processed in accordance with this invention had surface roughnesses of about 350 to about 402 μinch (about 8.9 to about 10.2 μm) Ra, while those processed in accordance with the prior art had surface roughnesses of about 300 to about 800 μinch (about 7.6 to about 20.3 μm) Ra. However, of greater significance to the present invention, the bond coats processed in accordance with this invention had surface area ratios of about 1.48, while those processed in accordance with the prior art had surface area ratios of about 1.33. Surface area ratio measurements were performed with a Wyko vertical scanning inferometer.

Following deposition of the ceramic by APS, the specimens underwent furnace cycle testing at 1090° C., with spallation of the ceramic being observed and quantified at regular intervals. The number of cycles completed by each specimen when 20% spallation had occurred was recorded, with the result that specimens aluminized in accordance with this invention completed an average of about 440 furnace cycles, while the specimens aluminized in accordance with the prior art completed an average of about 20 to 120 furnace cycles. Accordingly, though all specimens had similar surface roughnesses, the specimens processed in accordance with this invention to have surface area ratios of at least 1.4 exhibited significantly improved thermal cycle durability as compared to those processed in accordance with the prior art. Accordingly, sole reliance on surface roughness as conventionally done in the art would not have identified the critical difference between the VPA processes of this invention and the prior art.

While our invention has been described in terms of a preferred embodiment, it is apparent that other forms could be adopted by one skilled in the art. Accordingly, the scope of our invention is to be limited only by the following claims.

What is claimed is:

1. A process for forming a thermal barrier coating system on a surface of a superalloy component, the method comprising the steps of:

plasma spraying an MCrAlY bond coat on the surface of the component to have a surface roughness of at least 300 μinch Ra and a surface area ratio of at least 1.4;

forming an inward diffusion aluminide layer in the surface of the bond coat using a vapor phase deposition process performed in a coating container and having process parameters that include a process temperature of about 925° C. to about 1040° C. and a process duration of four to twelve hours, the vapor phase deposition process using an aluminum donor containing 50 to 60 weight percent aluminum and an aluminum halide activator at a concentration of about 1.8 grams of activator per liter of coating container volume, the inward diffusion aluminide layer causing the surface of the bond coat to have an aluminum concentration of at least 30 weight percent while maintaining a surface roughness of at least 300 μinch Ra and a surface area ratio of at least 1.4; and depositing a ceramic layer on the bond coat.

2. A process as recited in claim 1, wherein the vapor phase deposition process employs $AlF_3$ as the aluminum halide activator.

3. A process as recited in claim 1, wherein the vapor phase deposition process employs $Co_2Al_5$ as the aluminum donor.

4. A process as recited in claim 1, wherein the surface roughness of the bond coat is about 300 μinch to about 800 μinch Ra after the step of forming the inward diffusion aluminide layer.

5. A process as recited in claim 1, wherein the surface of the bond coat is characterized by a nickel concentration of less than 50 weight percent after the step of forming the inward diffusion aluminide layer.

6. A process as recited in claim 1, wherein the inward diffusion aluminide layer extends about 75 micrometers into the surface of the bond coat.

7. A process as recited in claim 1, wherein the surface of the bond coat is characterized by a surface area ratio of at least 1.6.

8. A process for forming a thermal barrier coating system on a surface of a nickel-base superalloy component, the method comprising the steps of:

plasma spraying an MCrAlY bond coat on the surface of the component to have a surface roughness of 300 μinch to 800 μinch Ra and a surface area ratio of at least 1.4;

forming an inward diffusion aluminide layer in the surface of the bond coat using a vapor phase deposition process performed in a coating container and having process parameters that include a process temperature of about 1010° C. and a duration of about six hours, the vapor phase deposition process using $Co_2Al_5$ as an aluminum donor and aluminum fluoride as an activator at a concentration of about 1.8 grams of activator per liter of coating container volume, the inward diffusion aluminide layer causing the surface of the bond coat to have an aluminum concentration of at least 30 weight percent and a nickel concentration of less than 50 weight percent while maintaining a surface roughness of at least 300 μinch to 800 μinch Ra and a surface area ratio of at least 1.4; and air plasma spraying a ceramic layer on the bond coat.

* * * * *